US009490552B1

(12) United States Patent
Peng

(10) Patent No.: US 9,490,552 B1
(45) Date of Patent: Nov. 8, 2016

(54) WIRE CONNECTOR HAVING TWO BODIES CONNECTED TOGETHER QUICKLY

(71) Applicant: Rich Brand Industries Limited, Dongguan, Guandong Province (CN)

(72) Inventor: Te-Shui Peng, Taoyuan (TW)

(73) Assignee: Rich Brand Industries Limited, Dongguan (CN)

( * ) Notice: Subject to any disclaimer, the term of this patent is extended or adjusted under 35 U.S.C. 154(b) by 0 days.

(21) Appl. No.: 14/929,618

(22) Filed: Nov. 2, 2015

(51) Int. Cl.
*H01R 13/627* (2006.01)
*H01R 4/24* (2006.01)

(52) U.S. Cl.
CPC ..... *H01R 4/2404* (2013.01); *H01R 13/627* (2013.01)

(58) Field of Classification Search
CPC ..... H01R 4/24; H01R 4/242; H01R 4/2429; H01R 4/2433; H01R 13/62; H01R 13/627; H01R 13/639
USPC ..... 439/395, 404, 346, 347, 352, 355
See application file for complete search history.

(56) References Cited

U.S. PATENT DOCUMENTS 7,540,760 B1 * 6/2009 Chen ..... H01R 4/2433 439/409
7,607,934 B1 10/2009 Yang
2007/0293080 A1 * 12/2007 Miyamoto ..... H01R 13/5205 439/352
2010/0194119 A1 * 8/2010 Ishigami ..... H01R 13/627 292/128
2012/0322319 A1 * 12/2012 Umetsu ..... H01R 13/193 439/692
2013/0137289 A1 * 5/2013 Youn ..... H01R 13/53 439/352
2013/0210258 A1 * 8/2013 Retailleau ..... H01R 13/6276 439/345
2015/0311635 A1 * 10/2015 Yeh ..... H01R 12/716 439/370

* cited by examiner

*Primary Examiner* — Chandrika Prasad
(74) *Attorney, Agent, or Firm* — Alan D. Kamrath; Kamrath IP Lawfirm, P.A.

(57) ABSTRACT

A wire connector is formed by a male base body and a female base body, and the male base body and the female base body are provided fro connecting and conducting a wire quickly, and the male base body and the female base body are connected and conducted, so that two wires can be connected quickly to achieve the effects of shortening the assembling process and improving the assembling efficiency and the market competitiveness.

9 Claims, 8 Drawing Sheets

WIRE CONNECTOR HAVING TWO BODIES CONNECTED TOGETHER QUICKLY

BACKGROUND OF THE INVENTION

1. Field of the Invention

The present invention relates to a wire connector, and more particularly to the wire connector capable of connecting two wires quickly to shorten the assembling process and improve the assembling efficiency and market competitiveness.

2. Description of the Related Art

In daily life, there is always a need to connect a wire particularly an electric wire (such as a power wire or a signal line) for extensions or split connections. Therefore, it is very common to connect two electric wires. At early stage, connecting means such as bolts or rivets are used for connecting the wires, and objects such as connectors are developed later. For example, an "INSTANT INSERTION AND EXTRACTABLE WIRE CONNECTOR" as disclosed in U.S. Pat. No. 7,607,934 is a connector used for connecting the electric wires.

The wire connector as disclosed in U.S. Pat. No. 7,607,934 comprises a shell, a clip, at least two wire extracting chunks, an insert and a cover. In an operation of connecting electric wires, it is necessary to process both ends of a wire to form bare ends before inserting the wire into a connector. The electric wire cannot be connected if the two ends of the electric wire are processed into bare ends, and this is the major drawback of the conventional electric wire connector. While everyone is busy at work, it is cumbersome to process the ends of the electric wire into bare ends, not just wasting time, but also lowering the assembling efficiency and the market competitiveness.

SUMMARY OF THE INVENTION

In view of the foregoing drawbacks of the prior art, the inventor or the present invention designed and developed a wire connector in accordance with the present invention to overcome the drawbacks of the prior art.

Therefore, it is a primary objective of the present invention to provide a wire connector that connects two wires conveniently to shorten the assembling process and improve the assembling efficiency and the market competitiveness.

To achieve the aforementioned and other objectives, the present invention provides a wire connector comprised of a male base body and a female base body, and the male base body comprises a bottom casing, a cover and a connecting plate; and the female base body comprises a bottom casing, a cover and a connecting plate.

The top and the rear end of the bottom casing of the male base body are hollow, and an insert column is extended out from the front end of the male base body and two separating cylindrical spaces are formed in the male base body, and a latching rod is installed at the bottom of the rear end of the bottom casing, and a guide groove is formed on each of both sides higher than the latching rod and extended into the bottom casing up to the position of a stopper, and an isolation block is formed at the middle of an internal front section of the bottom casing, and a channel is formed between both sides of the isolation block and two sidewalls of the bottom casing, and the channels and the cylindrical spaces are communicated with each other respectively, and a pivoting hole groove is formed at the top of the two sidewalls of the bottom casing and proximate to the front end.

The rear wall of the cover of the male base body has two separating through holes and a latching hole formed at a lower position, and the through holes are penetrated inward to form two separating channels, and a pivoting shaft is extended separately from both sides of the top of the cover proximate to the front end.

The connecting plate of the male base body is made of an electrically conductive material and comes with a quantity of two, and the two connecting plates are arranged on left and right sides respectively, and each connecting plate has a plug plate disposed at the rear end are erected upwardly and a forwardly and slightly protruded contact bump, and the plug plate has a clip groove formed thereon, and the width of a portion of the connecting plate on the horizontal plate is reduced, such that a bending point is formed on each of both sides.

During assembling, the connecting plates are installed from the rear end of the bottom casing and moved forward along a channel until the bending points of the connecting plates are blocked by a wall, and the contact bumps of the connecting plates are entered into the corresponsive cylindrical spaces and remained at a lower layer.

The cover is installed by inserting the pivoting shaft into the corresponsive pivoting hole groove of the bottom casing, so that the cover is covered onto the bottom casing by using the pivoting shaft as an axis.

The top and rear end of the bottom casing of the female base body are hollow, and a slot column is extended out from the front end, and two cylindrical spaces are formed therein, and configured to be corresponsive to the two cylindrical spaces formed in the insert column of the bottom casing of the male base body respectively, and a latching rod is installed to the bottom of the rear end of the bottom casing and a guide groove formed at a position higher than both sides of the latching rod and extended into the bottom casing until the latching rod reaches a stopper, and an isolation block is formed at the middle of the front section inside the bottom casing, and a channel is formed separately between both sides of the isolation block and two sidewalls of the bottom casing, and the channels and the cylindrical spaces are communicated with one another respectively, and a protruding support portion is formed at the intersection of the channel and the cylindrical space, and a pivoting hole groove is formed at a front end proximate to the top of the two sidewalls of the bottom casing.

A rear wall of the cover of the female base body has two separating through holes formed thereon and a latching hole formed at a lower position, and the through holes are penetrated inward to form two separating channels respectively, and a pivoting shaft is extended outwardly from each of the front end of both sides of the top of the cover.

The connecting plate of the female base body is made of an electrically conductive material and comes with a quantity of two, and the two connecting plates are arranged on left and right sides respectively, and each connecting plate has a plug plate disposed at the rear end and erected upwardly and a forwardly and then upwardly extended and slightly concave contact bump, and the plug plate has a clip groove formed thereon, and after the connecting plate is upwardly protruded, the width is reduced to form a bending portion at a higher position on each of both sides.

During assembling, the connecting plates are installed from the rear end of the bottom casing and moved forward along a channel until the bending points of the connecting plates are blocked by the protruding support portion, and the contact bumps of the connecting plates are entered into the cylindrical space and remained at an upper layer.

The pivoting shaft of the cover is inserted into the corresponsive pivoting hole groove of the bottom casing, so that the cover is covered onto the bottom casing by using the pivoting shaft as an axis.

In the aforementioned wire connector, the male base body and the female base body have a pushing assistant portion formed on the top of the covers of the male base body and the female base body separately.

In the aforementioned wire connector, the male base body and the female base body have a set of pressing assistant portions formed at the bottom of the cover and disposed on the top walls inside the two channels at the bottoms of the covers of the male base body and the female base body respectively.

In the aforementioned wire connector, the pressing assistant portions disposed at the bottoms of the covers of the male base body and the female base body are downwardly protruding rough areas respectively.

In the aforementioned wire connector, the pivoting shaft of the cover of the male base body and the female base body has a bevel, such that the pivoting shaft may be rotated to enter into the pivoting hole groove of the bottom casing to define a pivotal connection status.

In the aforementioned wire connector, the male base body further includes a pressing assistant plate which is a block having two pressing assistant portions formed at the top of the pressing assistant plate, and the wall thickness and width of the pressing assistant plate are sufficient to allow the pressing assistant plate to extend along the guide grooves on both sides in the bottom casing of the male base body towards the interior of the bottom casing until the pressing assistant plate reaches the position of the stopper.

In the aforementioned wire connector, the female base body further includes a pressing assistant plate which is a block having two pressing assistant portions formed at the top of the pressing assistant plate, and the pressing assistant plate has wall thickness and width sufficient to allow the pressing assistant plate to extend along the guide grooves on both sides inside the bottom casing of the female base body towards the interior of the bottom casing, until the pressing assistant plate reaches the position of the stopper.

In the aforementioned wire connector, the channel of the bottom casing of the male base body has a stepped surface, and the connecting plate of the male base body has a downwardly and backwardly tilted latching plate punched and formed on the horizontal plate, and when the connecting plate moves forward along the channel, the latching plate abuts the stepped surface of the channel to achieve the purposes of latching and positioning.

In the aforementioned wire connector, the channel of the bottom casing of the female base body has a stepped surface, and the connecting plate of the female base body has a downwardly and backwardly tilted latching plate punched and formed on the horizontal plate, and when the connecting plate moves forward along the channel, the latching plate abuts the stepped surface of the channel for the purposes of latching and positioning.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
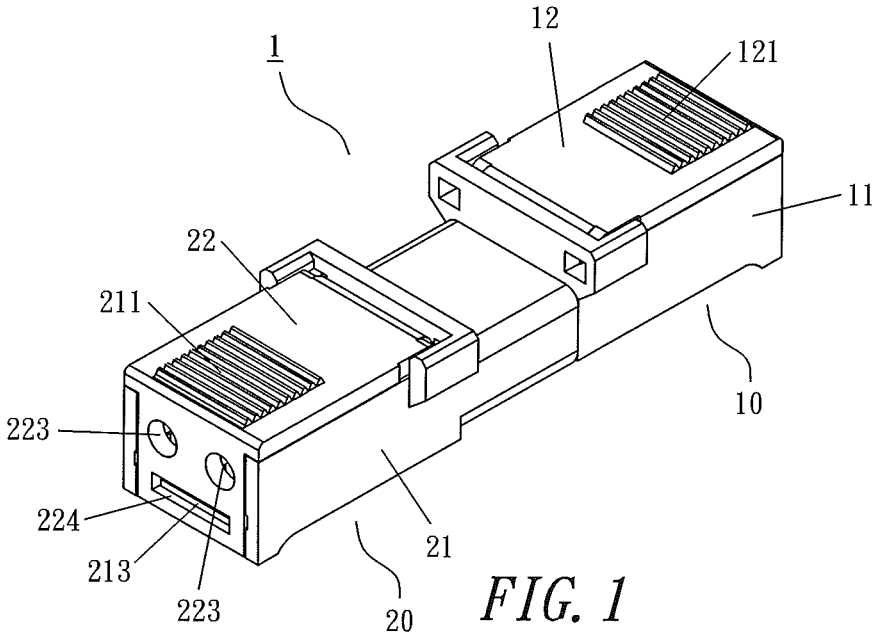
FIG. 1 is a perspective view of a wire connector in accordance with a preferred embodiment of the present invention, viewing at an angle of depression when the wire connector is being used.
Figure 2:
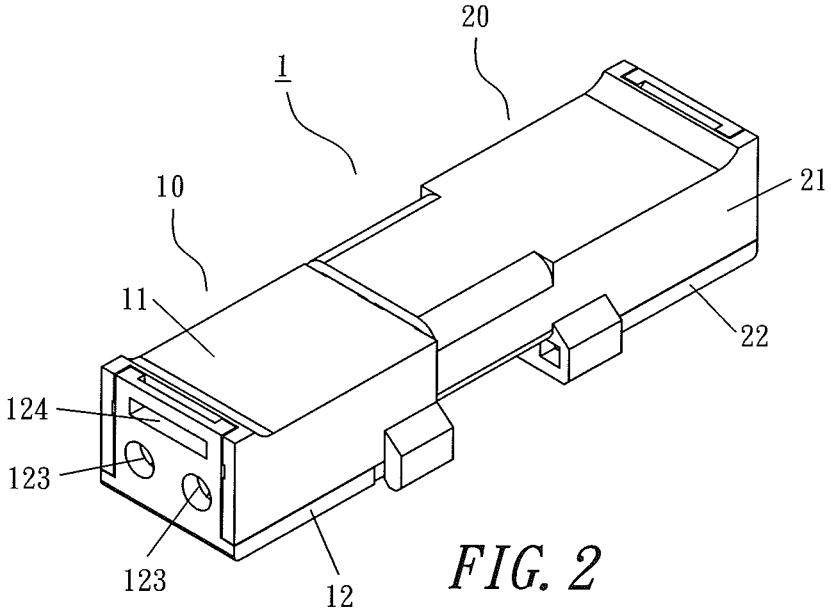
FIG. 2 is a perspective view of a wire connection in accordance with a preferred embodiment of the present invention, viewing at an angle of elevation when the wire connector is being used.
Figure 3:
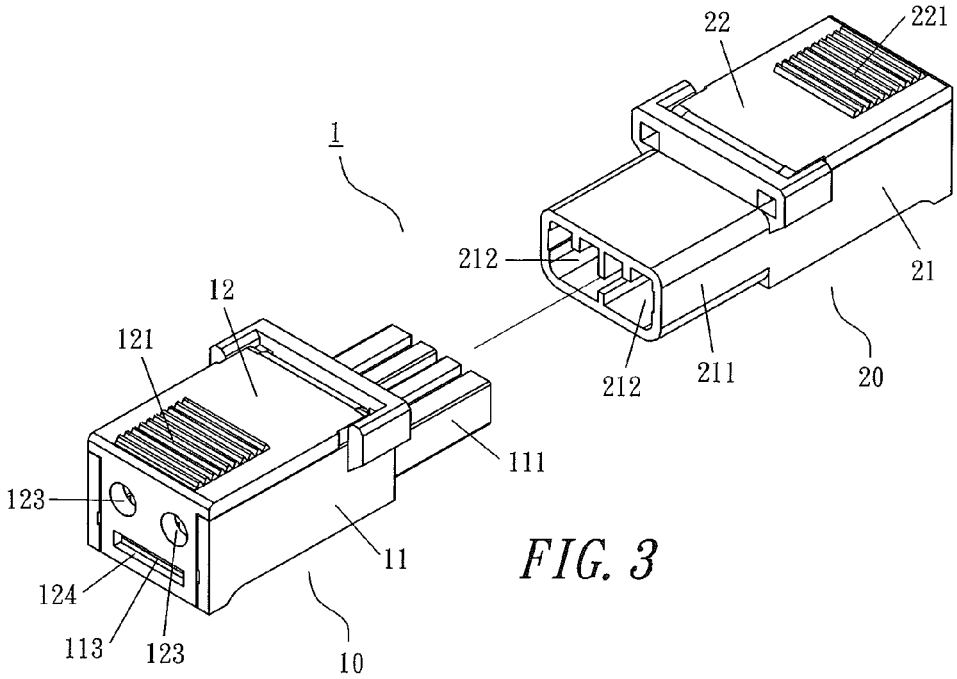
FIG. 3 is an exploded view of a wire connector in accordance with a preferred embodiment of the present invention, viewing at an angle of depression before the wire connector is used.
Figure 4:
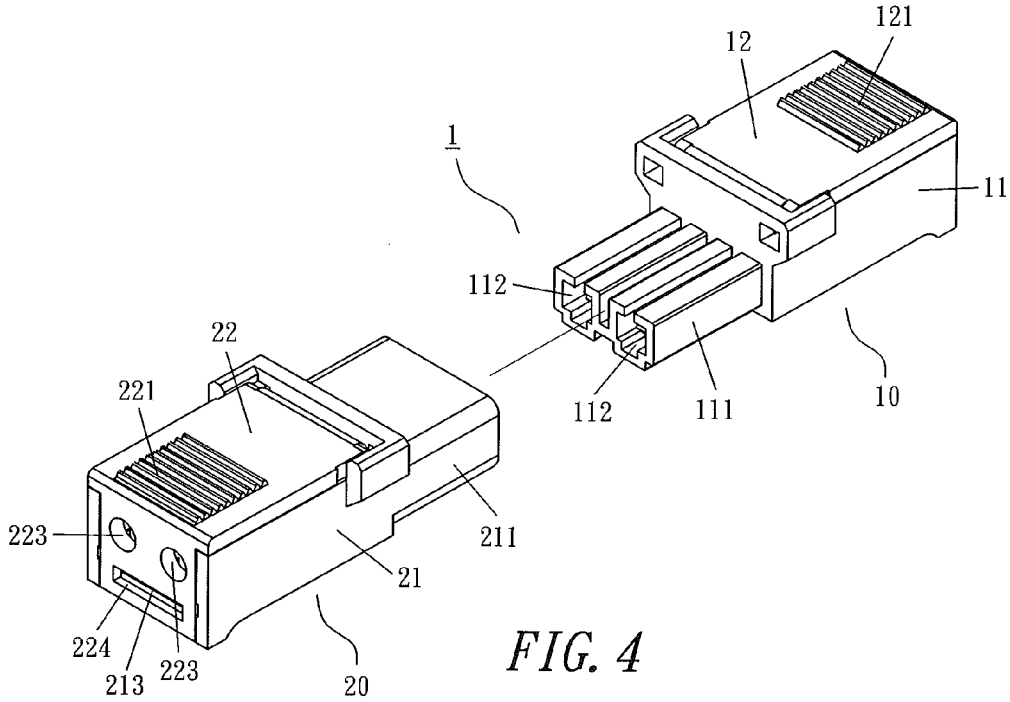
FIG. 4 is an exploded view of a wire connection in accordance with a preferred embodiment of the present invention, viewing at an angle of elevation before the wire connector is used.
Figure 5:
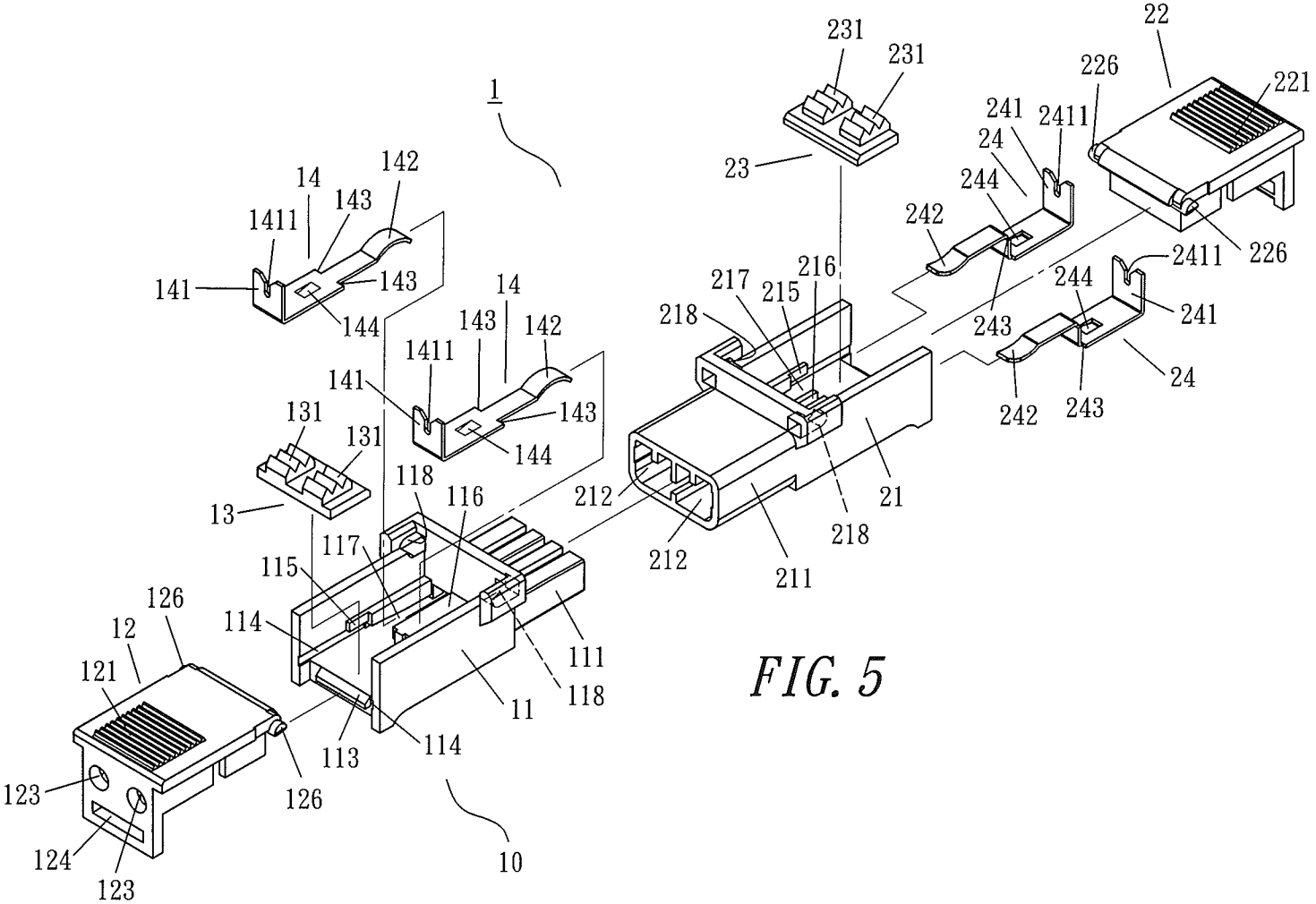
FIG. 5 is an exploded view of a wire connector in accordance with a preferred embodiment of the present invention.
Figure 6:
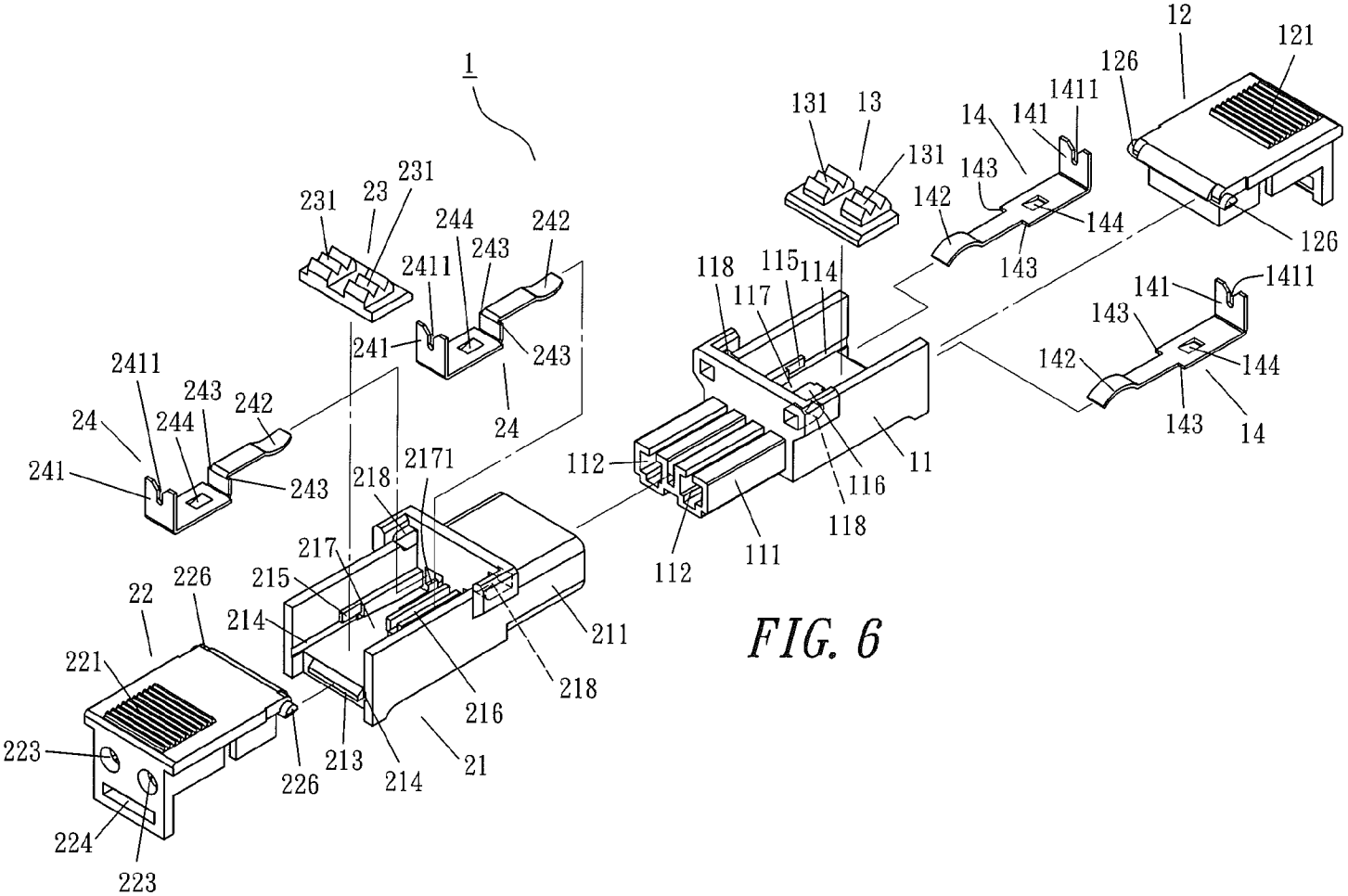
FIG. 6 is another exploded view of a wire connector in accordance with a preferred embodiment of the present invention, viewing at another angle.

In FIGS. 1 to 4 for a wire connector 1 in accordance with a preferred embodiment of the present invention, the wire connector 1 is comprised of a male base body 10 and a female base body 20. In other words, the male base body 10 and the female base body 20 are engaged to form the wire connector 1. In FIGS. 5 and 6, the male base body 10 comprises a bottom casing 11, a cover 12, a pressing assistant plate 13 and a connecting plate 14; and the female base body 20 comprises a bottom casing 21, a cover 22, a pressing assistant plate 23 and a connecting plate 24.

Figure 7:
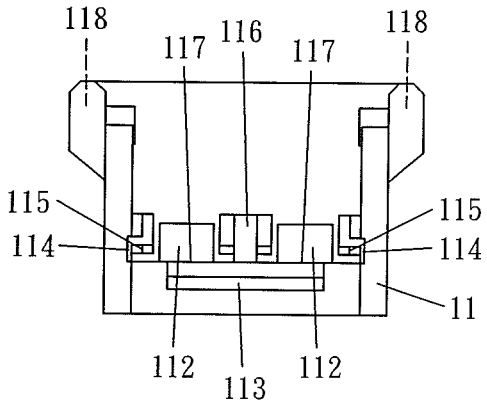
FIG. 7 is a rear view of a bottom casing of a male base body of a wire connector in accordance with a preferred embodiment of the present invention.
Figure 11:
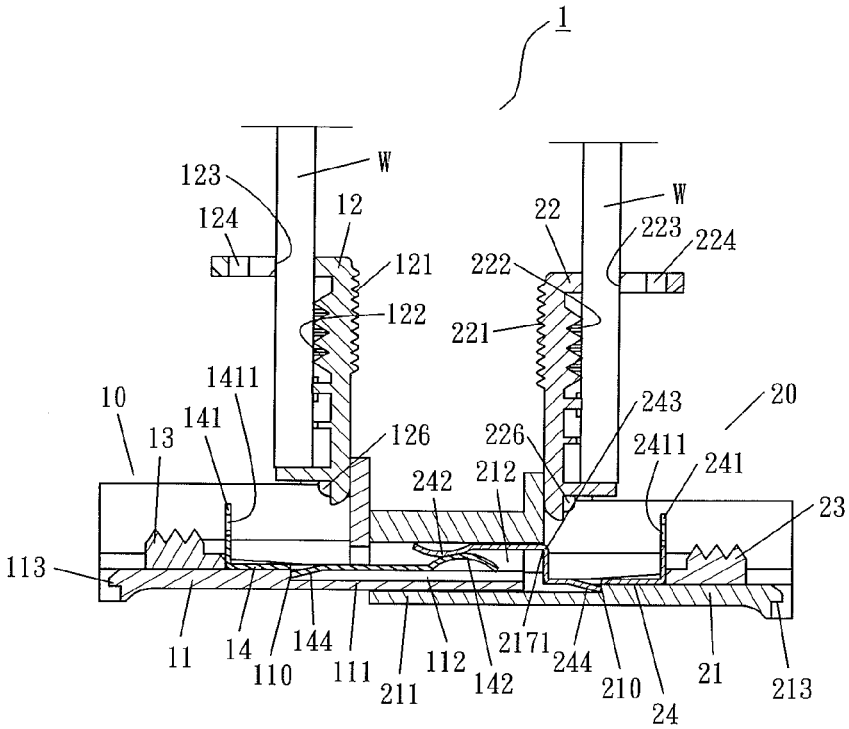
FIG. 11 is a sectional side view of a wire connector in accordance with a preferred embodiment of the present invention, when a wire is being connected.

In FIGS. 5 to 7, the top and rear end of the bottom casing 11 of the male base body 10 are hollow, and an insert column 111 is extended from the front end, and two separating cylindrical spaces 112 (as shown in FIG. 6) are formed therein, and a latching rod 113 is installed at the bottom of the rear end of the bottom casing 11, and a guide groove 114 is formed on each of both sides higher than the latching rod 113 and extended into the interior of the bottom casing 11 until the latching rod 113 reaches a stopper 115, and an isolation block 116 is formed at the middle of the front section inside the bottom casing 11, and a channel 117 is formed between both sides of the isolation block 116 and two sidewalls of the bottom casing 11 separately, and the channels 117 and the cylindrical spaces 112 are communicated with each other respectively, and a pivoting hole groove 118 is formed separately at the top sides of the two sidewalls of the bottom casing 11 respectively, and the channels 117 has a stepped surface 110 (as shown in FIG. 11).

Figure 8:
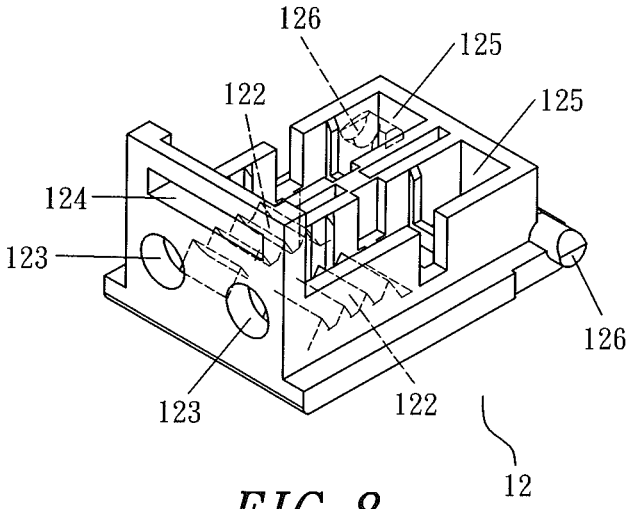
FIG. 8 is a perspective view of a cover of a male base body of a wire connector in accordance with a preferred embodiment of the present invention, viewing at an angle of depression.

In FIGS. 5, 6 and 8, a pushing assistant portion 121 is formed at the top of the cover 12 of the male base body 10, and a set of pressing assistant portions 122 are formed at the bottom to form downwardly protruding rough areas, and two separating through holes 123 are formed on a rear wall of the cover 12 and a latching hole 124 is formed at a lower position, and the through holes 123 are penetrated inward to form two separating channels 125 respectively, and the pressing assistant portions 122 are disposed on the top wall inside the two channels 125, and a pivoting shaft 126 is extended from the front end proximate to both sides of the top of the cover 12 separately and each pivoting shaft 126 has a bevel to facilitate users to rotate and enter the pivoting shaft 126 into the pivoting hole groove 118 of the bottom casing 11 to define a pivotal connection status.

In FIGS. 5 and 6, the pressing assistant plate 13 of the male base body 10 is a block having two pressing assistant portions 131 formed at the top, and the pressing assistant plate 13 has wall thickness and width sufficient to allow the pressing assistant plate 13 to extend along the guide grooves 114 formed on both sides inside the bottom casing 11 and into the interior of the bottom casing 11 until the pressing assistant plate 13 reaches the stopper 115.

In FIGS. 5 and 6, the connecting plate 14 of the male base body 10 is made of an electrically conductive material and comes with a quantity of two, and the two connecting plates 14 are arranged on left and right sides respectively, and each connecting plate 14 has a plug plate 141 disposed at the rear end and erected upwardly and a forwardly extended and slightly protruded contact bump 142, and the plug plate 141 has a clip groove 1411 formed thereon, and the width of a section of the connecting plate 14 on the horizontal plate is reduced, so that each of the two sides of the connecting plate 14 has a bending point 143, and a downwardly and backwardly tilted latching plate 144 is punched and formed on the horizontal plate.

Figure 12:
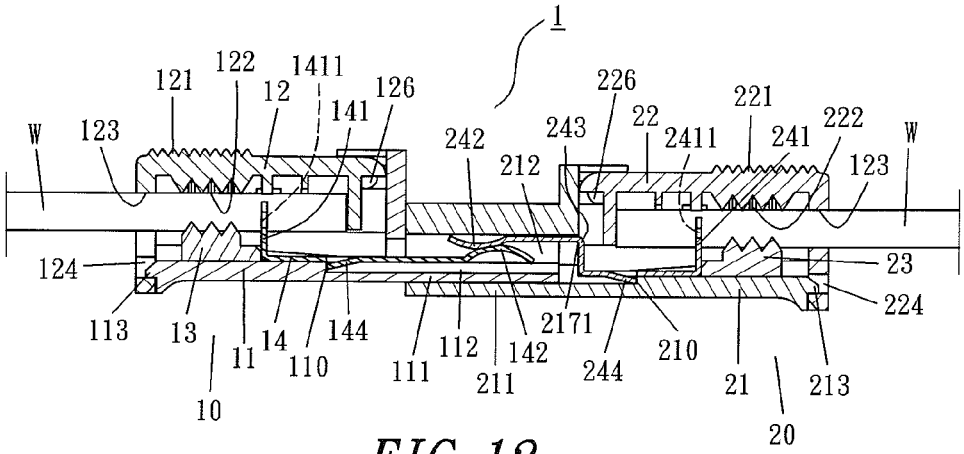
FIG. 12 is a sectional side view of a wire connector in accordance with a preferred embodiment of the present invention, after a wire is connected.

With reference to FIG. 11 for assembling the male base body 10, the connecting plates 14 are installed from the rear end of the bottom casing 11 and moved forward along a channel 117 until the connecting plates 14 reach each bending point 143 and are blocked by a tapered wall disposed at an intersection of the bottom of both sides of the bottom casing 11 and the isolation block 116 and the insert column 111. Now, the contact bumps 142 extended upwardly from the connecting plates 14 are entered into the corresponsive cylindrical space 112 and remained at a lower layer, while the downwardly and backwardly tilted latching plates 144 of the connecting plates 14 are abutting the stepped surfaces 110 of the channels 117 to achieve the purposes of latching and positioning (as shown in FIGS. 11 and 12), so that the connecting plates 14 cannot be withdrawn from the channels 117. Further, both sides of the pressing assistant plate 13 are installed along the guide grooves 114 formed on both internal sides of the bottom casing 11 and moved forward and towards the interior of the bottom casing 11 until both sides of the pressing assistant plate 13 are blocked by the stoppers 115, and then the pivoting shaft 126 of the cover 12 is inserted into the corresponsive pivoting hole groove 118 of the bottom casing 11, such that the cover 12 is covered onto the bottom casing 11 by using the pivoting shaft 126 as an axis. When the covered 12 is covered onto the bottom casing 11, the latching hole 124 of the cover 12 is provided for making a slightly deformation to cross the latching rod 113 of the bottom casing 11 to resume its original position, so that the cover 12 and the bottom casing 11 are connected tightly, and when the latching hole 124 of the cover 12 is slightly deformed to cross the latching rod 113 of the bottom casing 11, the cover 12 may be released from the bottom casing 11, so that the cover 12 can be lifted.

Figure 9:
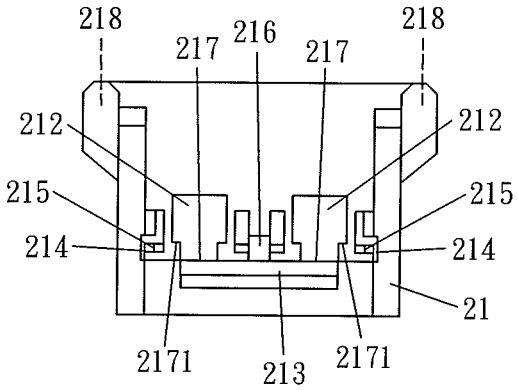
FIG. 9 is a rear view of a bottom casing of a female base body of a wire connector in accordance with a preferred embodiment of the present invention.

In FIGS. 5, 6 and 9, the top and rear end of the bottom casing 21 of the female base body 20 are hollow, and a slot column 211 is extended from the front end, and two cylindrical spaces 212 are formed therein (as shown in FIG. 5), and the two cylindrical spaces 212 are configured to be corresponsive to the two cylindrical spaces 112 formed in the front insert column 111 of the bottom casing 11 of the male base body 10 respectively. Particularly, the two cylindrical spaces 112 may be placed into the two cylindrical spaces 212 respectively to achieve the effect of connection.

A latching rod 213 is installed at the bottom of the rear end of the bottom casing 21 of the female base body 20, and a guide groove 214 is formed on each of both sides higher than the latching rod 213 and extended towards the interior of the bottom casing 21 until the latching rod 213 reaches a stopper 215, and an isolation block 216 is formed at the middle of a front section inside the bottom casing 11, and a channel 217 is formed between both sides of the isolation block 216 and two sidewalls of the bottom casing 21 separately, and the channels 217 and the cylindrical spaces 212 are communicated with each other respectively, and a protruding support portion 2171 is formed at the intersection of the channel 217 and the cylindrical space 212 (as shown in FIGS. 6, 9, 11 and 12), and a pivoting hole groove 218 is formed at a front end proximate to the top of the two sidewalls of the bottom casing 21, and each of the channels 217 has a stepped surface 210 (as shown in FIG. 11).

Figure 10:
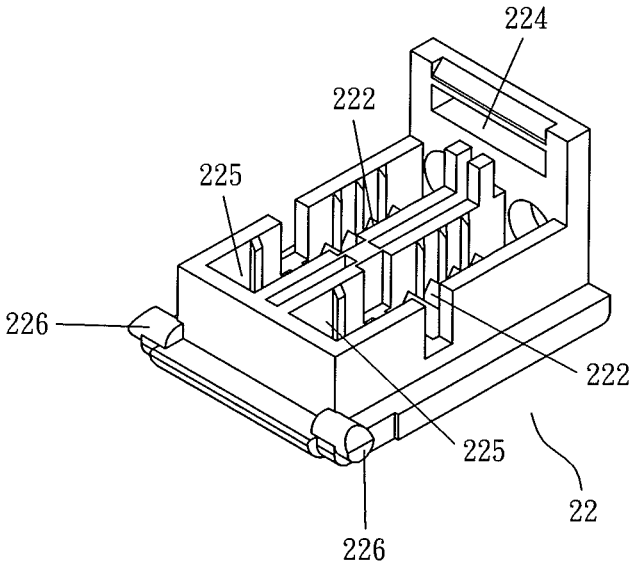
FIG. 10 is a perspective view of a cover of a female base body of a wire connector in accordance with a preferred embodiment of the present invention, viewing at an angle of elevation.

In FIGS. 5, 6 and 10, the female base body 20 has a pushing assistant portion 221 disposed at the top of the cover 22 and a pressing assistant portion 222 disposed at the bottom of the cover 22 to form downwardly protruding rough areas respectively, and two separating through holes 223 are formed on a rear wall of the cover 22 and a latching hole 224 formed at a lower position, and the through holes 223 are penetrated inwardly to form two separating channels 225 respectively, and the pressing assistant portions 222 are disposed on the top wall inside the two channels 225, and a pivoting shaft 226 is extended separately from both sides of the top of the cover 22 proximate to the front end and the pivoting shaft 226 has a bevel to facilitate users to rotate and enter the pivoting shaft 226 into the pivoting hole groove 218 of the bottom casing 21 to define a pivotal connection status.

In FIGS. 5 and 6, the pressing assistant plate 23 of the female base body 20 is a block and has two pressing assistant portions 231 formed at the top of the pressing assistant plate 23. The pressing assistant plate 23 has wall thickness and width sufficient to allow the pressing assistant plate 23 to extend along the guide grooves 214 formed on both sides inside the bottom casing 21 towards the interior of the bottom casing 21 until the pressing assistant plate 23 reaches the stopper 215.

In FIGS. 5 and 6, the connecting plate 24 of the female base body 20 is made of an electrically conductive material and comes with a quantity of two, and the two connecting plates 24 are arranged on left and right sides respectively, and each connecting plate 24 has a plug plate 241 disposed at the rear end and erected upwardly and a forwardly extended and then upwardly protruded and slightly concave contact bump 242, and the plug plate 241 has a clip groove 2411 formed thereon. After the connecting plate 24 is protruded upwardly from the horizontal plate, the width of the connecting plate 24 is reduced to form a bending point 243 at a high position on each of both sides of the connecting plate 24, and a downwardly and backwardly tilted latching plate 244 is punched and formed on the horizontal plate.

In the assembling procedure of the female base body 20 as shown in FIG. 11, the connecting plates 24 are installed from the rear end of the bottom casing 21 and moved forward along a channel 217 until the connecting plates 24 reach the protruding bending points 243 and blocked by the protruding support portion 2171 of the channel 217 (as shown in FIGS. 11 and 12). Now, the forwardly and upwardly protruded and extended contact bumps 242 of the connecting plates 24 are entered into the corresponsive cylindrical space 212 and remained at an upper layer, while the downwardly and backwardly tilted latching plates 244 of the connecting plates 24 abut the stepped surfaces 210 of the channels 217 respectively to achieve the purpose of latching and positioning (as shown in FIGS. 11 and 12), so that the connecting plates 24 cannot be withdrawn from the channels 217. Further, both sides of the pressing assistant plate 23 are installed into the guide grooves 214 formed on both sides inside the bottom casing 21 and moved forward towards the interior of the bottom casing 21 until the pressing plates 24 are blocked and stopped by the stoppers 215, and then the pivoting shaft 226 of the cover 22 is inserted into the corresponsive pivoting hole groove 218 of the bottom casing 21, so that the cover 22 can be covered onto the bottom casing 21 by using the pivoting shaft 226 as an axis. When the cover 22 is covered onto the bottom casing 21, the latching hole 224 of the cover 22 may be slightly deformed to cross the latching rod 213 of the bottom casing 21 to resume its original position, so that the cover 22 and the bottom casing 21 can be connected tightly, and then the latching hole 224 of the cover 22 can be slightly deformed to cross the latching rod 213 of the bottom casing 21, the connection between the cover 12 and the bottom casing 21 can be released, and the cover 22 can be lifted.

After a male base body 10 and a female base body 20 are assembled (to form a wire connector 1), the wire connector 1 can be used to connect two wires, and the wire connector 1 is specially applicable for connecting electric wires (such as power cables). During use, the male base body 10 and the female base body 20 are connected separately to an electric wire, and then the male base body 10 and the female base body 20 are engaged to electrically connect the two electric wires. The electric wire (such as the power cable) is composed of two wire bodies, each including a conductive wire harness and an insulating layer for covering the exterior of the conductive wire harness. During manufacture, the insulating layers of the two wire bodies are glue together, so that ends of the two wire bodies can be torn with a small distance to separate the two wire bodies in such distance. In FIG. 11, the cover 12 of the male base body 10 is lifted and the cover 22 of the female base body 20 is lifted. In the meantime, the insert column 111 of the male base body 10 is inserted into the corresponsive slot column 211 of the female base body 20. More precisely speaking, the cylindrical space 112 of the insert column 111 of the male base body 10 is inserted into the cylindrical space 212 of the slot column 211 of the female base body 20 to connect a male base body 10 with a female base body 20 securely. In such process, the upwardly protruded contact bump 142 of the connecting plate 14 of the male base body 10 and the downwardly concave contact bump 142 of the connecting plate 24 of the female base body 20 will be contacted with each other and cross each other to achieve a close contact and electrical conduction effect. Further, two wire bodies of a wire W are entered from two through holes 123 of the cover 12 of the male base body 10 respectively and moved downward along the two channels 125 of the cover 12 to the bottom side, while two wire bodies of another wire W are entered from two through holes 223 of the cover 22 of the female base body 20 respectively and moved downward along the two channels 225 of the cover 22 to the bottom side, and each wire body is touched by a pressing assistant portion 122, 222, and the status at that moment is shown in FIG. 11.

In FIG. 12, the pushing assistant portion 121 of the cover 12 of the male base body 10 applies a force to cover the cover 12 onto the bottom casing 11 by using the pivoting shaft 126 as an axis until the latching hole 124 of the cover 12 and the latching rod 113 of the bottom casing 11 are latched with each other to achieve a tightly covered status. In the meantime, the pushing assistant portion 221 of the cover 22 of the female base body 20 applies a force to cover the cover 22 of the female base body 20 onto the bottom casing 21 by using the pivoting shaft 226 as an axis until the latching hole 224 of the cover 22 and the latching rod 213 of the bottom casing 21 are latched with each other to achieve a tightly covered status. In such process, both of the cover 12 of the male base body 10 and the cover 22 of the female base body 20 drive the wires W to deflect from an erected status into horizontal status, and the pressing assistant portions 122, 222 and the pressing assistant portions 131, 231 of the pressing assistant plates 13, 23 jointly clamp the wire bodies of the wires W, and each wire body of the wires W is in contact with a clip groove 1411, 2411 of the plug plate 141, 241 of the connecting member 14, 24. In the tight covering process, each clip groove 1411, 2411 pierces the external insulating layer of each wire body and electrically connects and conducts the conductive wire harness in the wire body.

Therefore, the male base body 10 and the female base body 20 at both ends of the wire connector 1 are provided for connecting and conducting a wire W quickly, and then the connection between the male base body 10 and the female base body 20 allows that two wires W to be connected quickly, so as to shorten the assembling process and improves the assembling efficiency and the market competitiveness.

Figure 13:
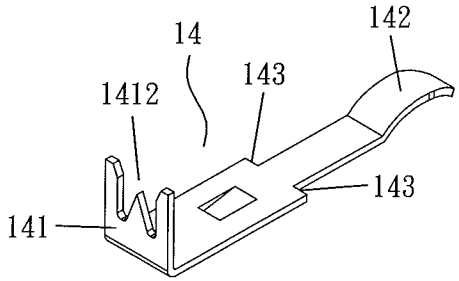
FIG. 13 is a perspective view showing a change of a connecting plate of a male base body in accordance with a preferred embodiment of the present invention.
Figure 14:
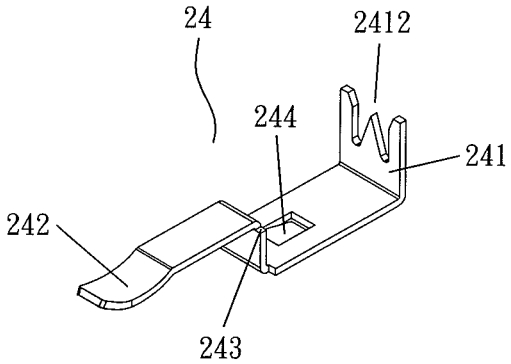
FIG. 14 is a perspective view showing a change of a connecting plate of a female base body in accordance with a preferred embodiment of the present invention.

The male base body 10 and the female base body 20 at both ends of the wire connector 1 play an important role for connecting and conducting the wires W quickly, and the clip groove 1411, 2411 of the plug plate 141, 241 of the connecting member 14 can transversally pierce the external insulating layer of each wire body of the wire W and clamp the conductive wire harness in the wire body to achieve the effects of electric connection. Basically, the clip groove 1411, 2411 comprises a deep groove for piercing the insulating layer and clamping the conductive wire harness. The clip grooves 1411, 2411 as shown in FIGS. 5, 6 and 11, 12 have a single deep groove, and the plug plates 141, 241 of the connecting members 14, 24 may also be manufactured with a clip groove 1412, 2412 having two deep grooves 2412 as shown in FIGS. 13 and 14 in order to fit a larger wire W. In other words, a different wire connector 1 may be selected according to the size of the wire W. For a smaller wire W, a smaller wire connector 1 (with a clip groove 1411, 2411 having a single deep groove) is preferred. For a larger wire W, a larger wire connector 1 (with a clip groove 1412, 2412 having two deep grooves) is preferred. Similarly, the clip groove of the plug plate 141, 241 may have three or more deep grooves, and modifications and variations of such structural details could be made thereto by those skilled in the art without departing from the scope and spirit of the invention set forth in the claims.

What is claimed is:

1. A wire connector, comprising a male base body and a female base body, and the male base body comprising a bottom casing, a cover and a connecting plate, and the female base body comprising a bottom casing, a cover and a connecting plate, characterized in that:

the top and the rear end of the bottom casing of the male base body are hollow, and an insert column is extended out from the front end of the male base body and two separating cylindrical spaces are formed in the male base body, and a latching rod is installed at the bottom of the rear end of the bottom casing, and a guide groove is formed on each of both sides higher than the latching rod and extended into the bottom casing up to the position of a stopper, and an isolation block is formed at the middle of an internal front section of the bottom casing, and a channel is formed between both sides of the isolation block and two sidewalls of the bottom casing, and the channels and the cylindrical spaces are communicated with each other respectively, and a pivoting hole groove is formed at the top of the two sidewalls of the bottom casing and proximate to the front end;

the rear wall of the cover of the male base body has two separating through holes and a latching hole formed at a lower position, and the through holes are penetrated inward to form two separating channels, and a pivoting shaft is extended separately from both sides of the top of the cover proximate to the front end;

the connecting plate of the male base body is made of an electrically conductive material and comes with a quantity of two, and the two connecting plates are arranged on left and right sides respectively, and each connecting plate has a plug plate disposed at the rear end are erected upwardly and a forwardly and slightly protruded contact bump, and the plug plate has a clip groove formed thereon, and the width of a portion of the connecting plate on the horizontal plate is reduced, such that a bending point is formed on each of both sides;

during assembling, the connecting plates are installed from the rear end of the bottom casing and moved forward along a channel until the bending points of the connecting plates are blocked by a wall, and the contact bumps of the connecting plates are entered into the corresponsive cylindrical spaces and remained at a lower layer;

the cover is installed by inserting the pivoting shaft into the corresponsive pivoting hole groove of the bottom casing, so that the cover is covered onto the bottom casing by using the pivoting shaft as an axis;

the top and rear end of the bottom casing of the female base body are hollow, and a slot column is extended out from the front end, and two cylindrical spaces are formed therein, and configured to be corresponsive to the two cylindrical spaces formed in the insert column of the bottom casing of the male base body respectively, and a latching rod is installed to the bottom of the rear end of the bottom casing and a guide groove formed at a position higher than both sides of the latching rod and extended into the bottom casing until the latching rod reaches a stopper, and an isolation block is formed at the middle of the front section inside the bottom casing, and a channel is formed separately between both sides of the isolation block and two sidewalls of the bottom casing, and the channels and the cylindrical spaces are communicated with one another respectively, and a protruding support portion is formed at the intersection of the channel and the cylindrical space, and a pivoting hole groove is formed at a front end proximate to the top of the two sidewalls of the bottom casing;

a rear wall of the cover of the female base body has two separating through holes formed thereon and a latching hole formed at a lower position, and the through holes are penetrated inward to form two separating channels respectively, and a pivoting shaft is extended outwardly from each of the front end of both sides of the top of the cover;

the connecting plate of the female base body is made of an electrically conductive material and comes with a quantity of two, and the two connecting plates are arranged on left and right sides respectively, and each connecting plate has a plug plate disposed at the rear end and erected upwardly and a forwardly and then upwardly extended and slightly concave contact bump, and the plug plate has a clip groove formed thereon, and after the connecting plate is upwardly protruded, the width is reduced to form a bending portion at a higher position on each of both sides;

during assembling, the connecting plates are installed from the rear end of the bottom casing and moved forward along a channel until the bending points of the connecting plates are blocked by the protruding support portion, and the contact bumps of the connecting plates are entered into the cylindrical space and remained at an upper layer; and the pivoting shaft of the cover is inserted into the corresponsive pivoting hole groove of the bottom casing, so that the cover is covered onto the bottom casing by using the pivoting shaft as an axis.

2. The wire connector according to claim 1, wherein the male base body and the female base body have a pushing assistant portion formed on the top of the covers of the male base body and the female base body separately.

3. The wire connector according to claim 1, wherein the male base body and the female base body have a set of pressing assistant portions formed at the bottom of the cover and disposed on the top walls inside the two channels at the bottoms of the covers of the male base body and the female base body respectively.

4. The wire connector according to claim 3, wherein the pressing assistant portions disposed at the bottoms of the covers of the male base body and the female base body are downwardly protruding rough areas respectively.

5. The wire connector according to claim 1, wherein the pivoting shaft of the cover of the male base body and the female base body has a bevel, such that the pivoting shaft may be rotated to enter into the pivoting hole groove of the bottom casing to define a pivotal connection status.

6. The wire connector according to claim 1, wherein the male base body further includes a pressing assistant plate which is a block having two pressing assistant portions formed at the top of the pressing assistant plate, and the wall thickness and width of the pressing assistant plate are sufficient to allow the pressing assistant plate to extend along the guide grooves on both sides in the bottom casing of the male base body towards the interior of the bottom casing until the pressing assistant plate reaches the position of the stopper.

7. The wire connector according to claim 1, wherein the female base body further includes a pressing assistant plate which is a block having two pressing assistant portions formed at the top of the pressing assistant plate, and the pressing assistant plate has wall thickness and width sufficient to allow the pressing assistant plate to extend along the guide grooves on both sides inside the bottom casing of the female base body towards the interior of the bottom casing, until the pressing assistant plate reaches the position of the stopper.

8. The wire connector according to claim 1, wherein the channel of the bottom casing of the male base body has a stepped surface, and the connecting plate of the male base body has a downwardly and backwardly tilted latching plate punched and formed on the horizontal plate, and when the connecting plate moves forward along the channel, the latching plate abuts the stepped surface of the channel to achieve the purposes of latching and positioning.

9. The wire connector according to claim 1, wherein the channel of the bottom casing of the female base body has a stepped surface, and the connecting plate of the female base body has a downwardly and backwardly tilted latching plate punched and formed on the horizontal plate, and when the connecting plate moves forward along the channel, the latching plate abuts the stepped surface of the channel for the purposes of latching and positioning.

* * * * *